United States Patent [19]

Busenhart et al.

[11] Patent Number: 4,969,607

[45] Date of Patent: Nov. 13, 1990

[54] APPARATUS FOR INTRODUCING A YARN INTO THE CATCH SLOT OF AN EMPTY BOBBIN TUBE

[75] Inventors: Peter Busenhart; Heinz Mutter, both of Winterthur, Switzerland

[73] Assignee: Rieter Machine Works Ltd., Winterthur, Switzerland

[21] Appl. No.: 426,720

[22] Filed: Oct. 26, 1989

[30] Foreign Application Priority Data

Nov. 4, 1988 [CH] Switzerland ..... 04104/88
Apr. 11, 1989 [CH] Switzerland ..... 01370/89

[51] Int. Cl.[5] ..... B65H 67/48; B65H 65/00
[52] U.S. Cl. ..... 242/18 A; 242/18 PW
[58] Field of Search ..... 242/18 A, 18 PW, 25 A

[56] References Cited

U.S. PATENT DOCUMENTS 3,695,521 10/1972 Torii et al. ..... 242/18 A
3,913,852 10/1975 Lenk et al. ..... 242/18 A
3,999,715 12/1976 Schippers et al. ..... 242/18 A
4,033,519 7/1977 Abe et al. ..... 242/18 A
4,210,293 7/1980 Fromaget ..... 242/18 A
4,283,019 8/1981 Gujer ..... 242/18 A

FOREIGN PATENT DOCUMENTS 0211748 2/1987 European Pat. Off. .
2015046 9/1979 United Kingdom .

*Primary Examiner*—Stanley N. Gilreath
*Attorney, Agent, or Firm*—Sandler, Greenblum & Bernstein

[57] ABSTRACT

The apparatus for introducing a yarn or the like into the yarn catch slot of an empty bobbin tube during the changeover operation from a full bobbin to an empty bobbin at an automatic yarn winder, comprises a yarn deflector, formed of sheet metal for instance, which is provided with cutouts. Each cutout serves for deflecting an associated yarn out of an imaginary plane extending through a yarn ridge. In order to ensure that the yarn, which is still arriving at the yarn ridge of the full bobbin during the changeover operation can be infed within the imaginary plane through the yarn ridge and at the same time can extend in the plane through the yarn catch slot, the yarn is pulled by a displaceable yarn entrainment member over a curved portion of the associated cutout and deviated or deflected at the associated yarn entrainment hook.

13 Claims, 4 Drawing Sheets

APPARATUS FOR INTRODUCING A YARN INTO THE CATCH SLOT OF AN EMPTY BOBBIN TUBE

BACKGROUND OF THE INVENTION

The present invention broadly relates to automatic yarn winders or winding apparatus and, more specifically, pertains to a new and improved apparatus for introducing a yarn or the like into the catch slot of an empty bobbin tube.

In its more particular aspects, the present invention relates to a new and improved apparatus for introducing a yarn or the like into the catch slot of an empty bobbin tube during a changeover or changing operation from a full bobbin to an empty bobbin at an automatic winder or winding apparatus. The automatic winder or winding apparatus is of the turret type comprising at least two bobbin spindles or chucks, which are mounted in cantilever fashion at a turret or revolver, and a yarn guide which can be shifted into the travel path of the incoming yarn for forming a yarn ridge at the surface of the full bobbin.

In the case of automatic turret-type winders where the bobbins are supported at a rotatable turret or revolver, the incoming yarn or thread or the like must be transferred without interruption from the full bobbin to the yarn catch slot of an empty bobbin tube and engaged by the yarn catch slot before there is accomplished a separation or cutting of the yarn or thread from the full bobbin. During the winding operation the incoming or arriving yarn or thread is delivered by the yarn guide directly or else indirectly by means of the drive roll to the surface of the bobbin being packaged. During the changeover or changing operation, that is to say, upon rotation of the turret or revolver, the empty bobbin tube arrives at this path of travel of the yarn. By axially shifting or displacing the bobbin spindle or chuck carrying the bobbin tube or the full size yarn bobbin package it is possible with conventional automatic winders to guide the yarn catch slot at the empty bobbin tube into the yarn path of travel, so that the yarn or thread is clamped at the catch slot and carried along by the empty bobbin tube. At the same time there is severed or cut the yarn or thread between the fresh bobbin tube and the full bobbin.

This known apparatus renders possible a faultless yarn transfer from a full packaged bobbin to a fresh bobbin. However, it is afflicted with the drawback that particularly in the case of automatic winders or winding apparatus working with bobbin spindles or chucks for a number of bobbins it is necessary to briefly accelerate a very large mass, in order to carry out the axial displacement. The technical expenditure for the displacement of the spindle or chuck is extremely high and thus has a negative effect on the fabrication costs.

SUMMARY OF THE INVENTION

Therefore, with the foregoing in mind it is a primary object of the present invention to provide an improved apparatus for introducing a yarn or the like into the yarn catch slot of an empty bobbin tube in a manner which is not afflicted with the aforementioned drawbacks and limitations of the prior art.

Another and more specific object of the present invention aims at providing a new and improved construction of bobbin changeover system which reliably transfers the yarn or the like from a full bobbin package to an empty or fresh bobbin tube.

A further significant object of the present invention aims at the provision of a new and improved construction of apparatus which renders possible a yarn transfer from the full bobbin to the empty bobbin tube without necessitating any axial displacement of the winding spindle or chuck or mandril.

Yet a further significant object of the present invention is directed to an apparatus of the character described which allows continuing the formation of the yarn ridge upon the outer surface of the full size yarn package of the full bobbin during the insertion of the incoming yarn into the yarn catch slot, in other words, enables using the continuously arriving yarn during the bobbin changeover operation for forming the yarn ridge.

Now in order to implement these and still further objects of the invention, which will become more readily apparent as the description proceeds, the apparatus of the present development is manifested, among other things, by the features that there is provided a yarn deflector or guide member, for instance formed of sheet metal, which can be moved into the path of travel of the yarn between the empty bobbin tube and the full bobbin. This yarn deflector or guide member is provided with at least one cutout and a displaceable yarn entrainment member arranged laterally of the at least one cutout. This displaceable yarn entrainment member serves for the axial displacement of the yarn along a curved portion of the cutout and across the yarn catch slot at the empty bobbin tube while simultaneously maintaining the course of travel or infeed of the yarn onto the full bobbin.

By means of the inventive apparatus it is possible that the incoming yarn within a plane, which extends essentially perpendicular to the rotational axis of the bobbin spindles or chucks, is displaced across the empty bobbin tube to the yarn catch slot and at the same time it is possible to retain axially non-displaceable the yarn which travels to the full bobbin for the formation of the yarn ridge.

The apparatus of the present development enables guiding the incoming yarn or thread axially twice across or over the yarn catch slot so that there is ensured that the yarn or thread, should such as an exception not be engaged during its first travel across or over the yarn catch slot, will be positively clamped and carried along during its second travel over the yarn catch slot.

BRIEF DESCRIPTION OF THE DRAWINGS

The invention will be better understood and objects other than those set forth above will become apparent when thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
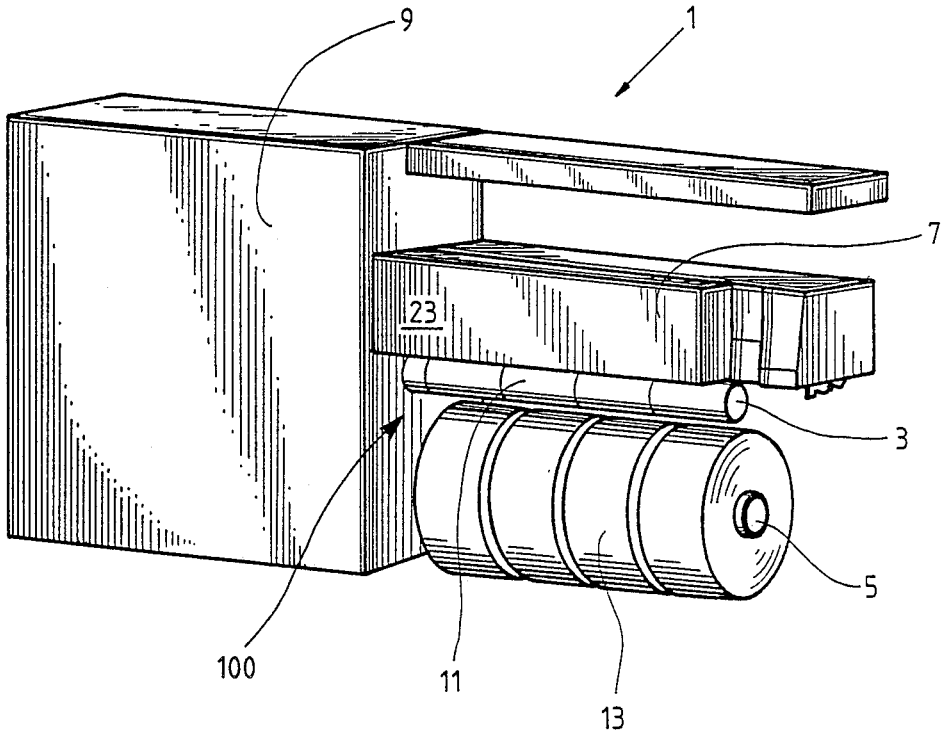
FIG. 1 is a schematic perspective illustration of an automatic winder or winding apparatus for four bobbins.

Describing now the drawings, it is to be understood that for purposes of simplifying the illustration thereof there has only been shown enough of the construction of the automatic winder or winding apparatus and associated components as needed for one skilled in the art to readily understand the underlying principles and concepts of the present development. Turning attention now specifically to FIG. 1, there is depicted therein an automatic winder or winding apparatus 1 having two bobbin spindles or chucks or mandrils 3 and 5 which are mounted at a suitable turret or turret disc or revolver, the location thereof being generally indicated by reference numeral 100, and a yarn laying-in device 7 of known construction. There is also depicted a machine housing 9 which contains the drive motors for the bobbin spindles or chucks 3 and 5 of the turret 100, the yarn laying-in device 7 and the remaining units as well as parts of the automatic control equipment. The turret or revolver 100 which carries both of the bobbin spindles or chucks or mandrils 3 and 5 has not been here further illustrated since it is of known design. Both of the bobbin spindles or chucks or mandrils 3 and 5 are mounted in cantilever or overhang fashion. In this manner, the bobbin spindles or chucks 3 and 5, as appropriate, can be loaded with empty bobbin tubes 11 and the removal of the full size yarn packages or full bobbins 13 can be accomplished manually or by an automatic doffer.

Figure 2:
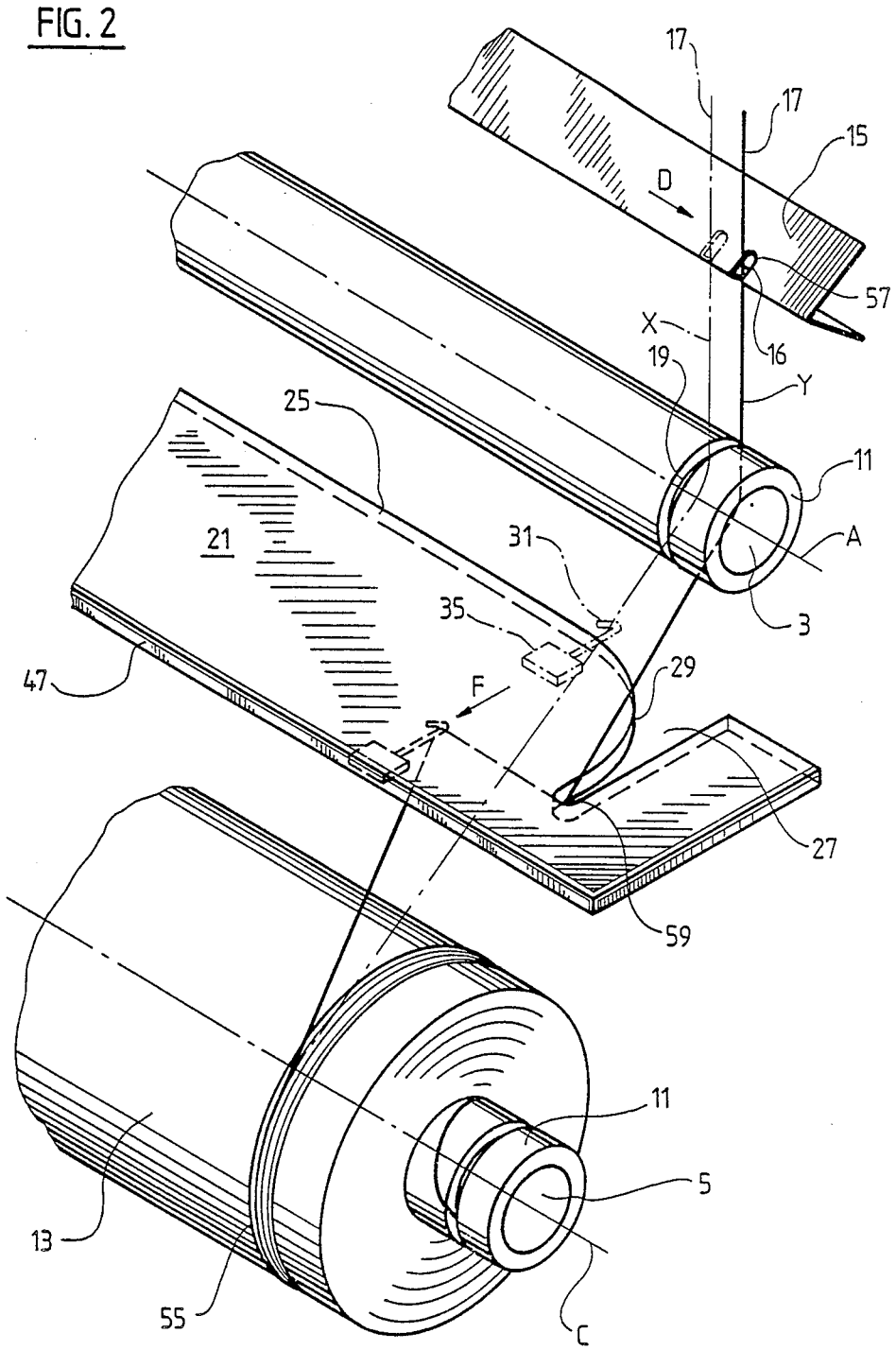
FIG. 2 is a perspective view in fragmentary illustration of the overhanging or cantilevered ends of both of the bobbin or winding spindles or chucks.
Figure 5:
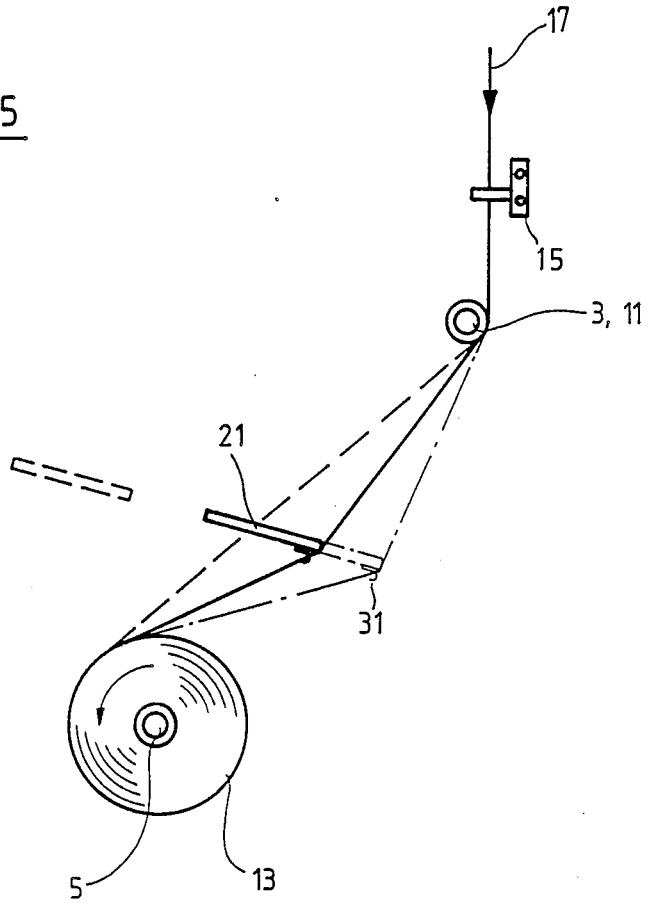
FIG. 5 is a schematic illustration of the course or travel path of a yarn or the like during the bobbin changeover operation.

A yarn guide member 15, for instance formed of sheet metal, is arranged above the bobbin spindle or chuck 3 which has been pivoted upwardly in the showing of FIGS. 1, 2 and 5 into a winding position by rotating turret or turret disc or the revolver 100. This yarn guide member 15, during the bobbin changeover operation, deflects the incoming or inbound yarn 17 out of the yarn path of travel X depicted in dash-dot lines in FIG. 2 and which extends in an imaginary plane disposed substantially perpendicular to the axes of rotation A and C of the bobbin spindles or chucks 3 and 5, respectively, in the direction of the arrow D into a yarn path of travel Y which allows for yarn take-over by the empty or fresh bobbin tube 11. To accomplish such yarn take-over operation for the yarn or thread 17 there is formed in the empty bobbin tube 11 a continuous or endless yarn catch slot 19. After rotating the turret or revolver 100 the yarn 17 is deflected by the empty bobbin tube 11 out of the extended or straight yarn path of travel and wraps around the jacket or outer surface of the empty bobbin tube 11 throughout a limited angular range.

A yarn deflector or guide member 21, for instance likewise formed of sheet metal, is pivotably or displaceably mounted at the housing 23 which accommodates the yarn laying-in device 7. The pivotable or displaceable arrangement of the yarn deflector or guide member 21 is accomplished such that its front or upstream edge 25 deflects the yarn 17 between both of the bobbin spindles or chucks or mandrils 3 and 5. In FIG. 5 there has been illustrated in dash-dot lines the yarn path of travel during pivoting-in of the yarn deflector member 21 and in full lines the yarn path of travel after retraction of the yarn 17 by yarn entrainment means 31. At the sheet metal yarn deflector member 21 there is provided an essentially V-shaped cutout or incision 27. One leg of this cutout 27 is formed as a curved or arcuate-shaped portion 29. The design of the curved or arcuate-shaped portion 29 will be explained more fully in conjunction with FIG. 3. At the arcuate-shaped side of the cutout 27 there is mounted in the sheet metal yarn deflector or guide member 21 the yarn entrainment means or member 31. This yarn entrainment member 31 is arranged to be displaceable substantially perpendicular to the front or upstream edge 25 of the yarn deflector or guide member 21. The yarn entrainment member 31 is secured at a slide or slider member 35 which is guided in a groove or slot 33 and possesses an entrainment hook or hook member 36 which is disposed at an angle which is less than 90° with respect to the underside or bottom surface of the sheet metal yarn deflector member 21 and which faces away from the associated essentially V-shaped cutout 27.

The yarn deflector or guide member 21 comprises two components or parts 37 and 39, for instance likewise formed of sheet metal or metal plating. As best seen by referring to FIGS. 3 and 4, these two components or parts 37 and 39 are arranged at a slight spacing with respect to one another and form a substantially box-shaped structure. In the lower situated sheet metal component or part 37 there is formed the groove or slot 33 which serves for guiding the slide or slider member 35. As also will be best recognized by referring to FIG. 4, this slide or slider member 35 can have a substantially T-shaped configuration. A further possibility would be to provide for the slide or slider member 35 two guide bolts or bolt members 41 which penetrate through the associated groove or slot 33, one of which guide bolts or bolt members 41 then can be designed as the yarn entrainment hook or hook member 36.

Secured to the slide or slide member 35 is a pulling or displacement means, here for instance in the form of a cable or a rope 43 or equivalent structure which leads to a deflection roll or roller 45 which is arranged at the region of the rear or downstream edge 47 internally of the sheet metal yarn deflector or guide member 21. The cable or rope 43 extends from the deflection roll or roller 45 either to a pulling or traction device or terminates externally of the sheet metal yarn deflector or guide member 21, for instance in a loop 49 which can be manually engaged. As will be observed by referring to FIG. 3, an actuation lever or lever member 51 which is pivotably mounted upon a pivot shaft E is in contact with the rearward face or end of the slide or slide member 35 and is pressed thereagainst by the action of a tension spring 53.

Figure 3:
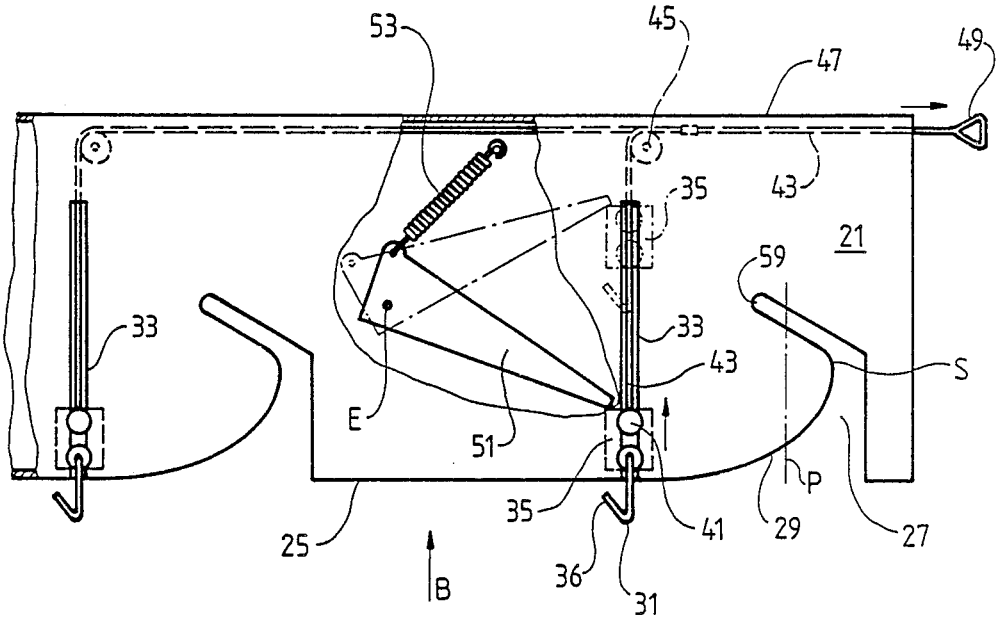
FIG. 3 is a fragmentary bottom plan view of part of the yarn deflector or guide member and shown cut away at the , region of the yarn entrainment member.
Figure 4:
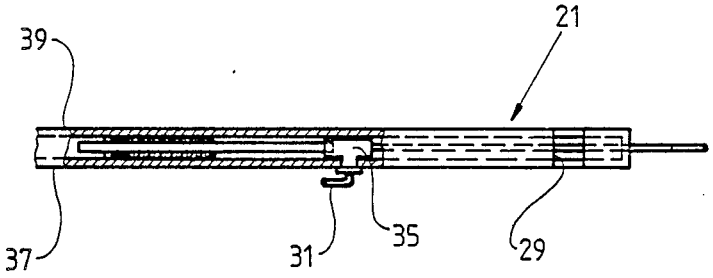
FIG. 4 is a fragmentary sectional view of the yarn deflector or guide member shown in FIG. 3 looking in the direction of the arrow B thereof.

In the description to follow there will be more fully explained in conjunction with FIGS. 2, 3 and 5 the function of the heretofore described apparatus.

After attaining a predetermined diameter of the yarn package, the full bobbin 13 and the empty bobbin tube 11 are pivoted or rotated through an angle of about 180° by the turret or revolver 100, as is well known in this technology. As a result, the surface of the empty bobbin tube 11 comes into contact with the yarn 17 which is still being delivered to the full bobbin or package 13. In order that a yarn ridge 55 or the like can be formed at the full size yarn package of the bobbin 13, the sheet metal yarn guide member 15 which has been displaced into the yarn path of travel X retains the yarn 17 so as to be axially non-displaceable. At the same time or shortly thereafter the yarn deflector or guide member 21 is forwardly advanced or pivoted in such a manner that its front or upstream edge 25 deflects the yarn 17 or the like between the surface of the empty bobbin tube 11 and the full bobbin 13. By virtue of accomplishing an axial displacement of the yarn guide member 15 in the direction of the arrow D the yarn 17 arrives beneath the yarn entrainment hook or hook member 36 and is further guided by the latter in such a fashion that the yarn 17 which arrives at the yarn ridge 55 travels in an imaginary plane disposed substantially perpendicular to the rotational axis C of the bobbin spindle or chuck 5.

In order to ensure that the inbound or arriving yarn 17 can be engaged by the yarn catch slot 19 at the empty bobbin tube 11, the yarn guide member 15 is further displaced axially to the right of the showing of FIG. 2 to such an extent that its guide slot 16 comes to lie in a plane extending substantially through the yarn catch slot 19. Simultaneous with the displacement of the yarn guide member 15 the yarn entrainment member 31 is retracted by the cable or rope 43 or equivalent structure beneath the sheet metal deflector member 21 in the direction of the arrow F of FIG. 2. As a result, the incoming yarn 17, which is deflected at the front or upstream edge 25, slides over the arcuate-shaped or curved portion 29 into the base or bottom 59 of the associated cutout or incision 27. This base or bottom 59 of the cutout 27 is located approximately in the plane extending through the yarn catch slot 19.

During the retraction of the yarn entrainment member 31 there is further accomplished without any disturbance the formation of the yarn ridge 55 at the full size yarn package of the full bobbin 13, since the incoming yarn 17, even though the latter has been deflected towards the right of the showing of FIG. 2 by the arcuate-shaped or curved portion 29, is always retained by the yarn or thread entrainment hook or hook member 36 in the imaginary plane extending through the yarn ridge 55.

According to a particularly advantageous design of the apparatus constructed according to the invention the curved or arcuate-shaped portion 29 depicted in FIG. 3 is constructed such that the yarn 17 crosses twice the yarn catch slot 19 upon retraction of the yarn entrainment member 31, that is to say, that the apex S (FIG. 3) of the arcuate-shaped or curved portion 29 is located to the far side of the plane P through the yarn catch slot 19. The actuation of the yarn entrainment member 31 can be accomplished by manually pulling at the cable loop 49. Alternatively, there can be provided any suitable electrical drive for exerting a pulling or traction action at the cable or rope 43. When pulling at this cable or rope 43 the spring member or element 53 is tensioned, so that after releasing the cable or rope 43 the yarn entrainment member 31 returns to its starting position.

As soon as the yarn 17 has been guided over or across the yarn catch slot 19, then such yarn 17 is fixedly clamped by the yarn catch slot 19 and is wound upon the empty or fresh bobbin tube or sleeve 11. Consequently, the section of the stretched yarn portion which leads to the full bobbin or package 13 tears or breaks by itself, or else it can be cut by an appropriate cutting device or knife or the like. As soon as the yarn 17 has been engaged by the yarn catch slot 19 then the yarn guide member 15 can be brought back into its starting position and the yarn 17 transferred to the yarn laying-in device 7.

The invention has been described by way of example in conjunction with a yarn entrainment member 31 and a cutout or incision 27. Of course, an automatic winder or winding apparatus 1 typically possesses a plurality of adjacently arranged full bobbins 13 and thus would be equipped with a corresponding number of yarn entrainment members 31 and cutouts or incisions 27.

While there are shown and described present preferred embodiments of the invention, it is to be distinctly understood that the invention is not limited thereto, but may be otherwise variously embodied and practiced within the scope of the following claims. ACCORDINGLY,

WHAT WE CLAIM IS:

1. An apparatus for introducing a yarn into a catch slot of an empty bobbin tube during a yarn changeover operation from a full bobbin to an empty bobbin at an automatic winder, comprising:

at least two bobbin spindles cantilever mounted at a turret;

a displaceable yarn guide means displaceable into a path of travel of an incoming yarn for forming a yarn ridge upon a surface of a full bobbin;

yarn deflector means moveable into the path of travel of the yarn between the full bobbin and an empty bobbin tube having a yarn catch slot;

said yarn deflector means being provided with a cutout;

a displaceable yarn entrainment member arranged laterally of said cutout of said yarn deflector means;

said cutout having a curved portion; and said displaceable yarn entrainment member serving for the axial displacement of the yarn along said curved portion of the cutout and across the catch slot at said empty bobbin tube while simultaneously maintaining the infeed of the yarn to said full bobbin.

2. The apparatus as defined in claim 1, wherein:

said yarn ridge defines a plane extending therethrough;

said cutout having a base and said curved portion being formed at one side of the cutout as an arcuate-shaped curved portion; and said arcuate-shaped curved portion penetrating said plane through said yarn ridge and terminating at said base of the cutout.

3. The apparatus as defined in claim 2, wherein:

said yarn catch slot at said empty bobbin tube defines a plane extending therethrough; and said arcuate-shaped curved portion twice intersects said plane through said yarn catch slot located at said empty bobbin tube.

4. The apparatus as defined in claim 1, wherein:

said yarn deflector means has a forward edge and a surface;

said yarn entrainment member comprises an arcuate-shaped hook member which protrudes beyond said forward edge of said yarn deflector means; and said arcuate-shaped hook member being disposed at an angle to the surface of said yarn deflector means and extending away from said cutout.

5. The apparatus as defined in claim 2, wherein:

said yarn deflector means comprises substantially linear groove means disposed in the plane extending through said yarn ridge;

said yarn entrainment member being disposed in said substantially linear groove means; and said yarn entrainment member being displaceably mounted beneath said yarn deflector means in the direction of said yarn ridge.

6. The apparatus as defined in claim 5, further including:

slide means guided in said groove means;

said yarn entrainment member being secured at said slide means guided in said groove means of said yarn deflector means;

a pulling element for displacing said yarn entrainment member;

spring means cooperating with said pulling element; and said pulling element displacing said yarn entrainment member against the force of said spring means.

7. The apparatus as defined in claim 6, wherein:

said pulling element comprises a cable secured to said slide means;

said yarn deflector means having a rear edge;

means for deflecting said cable at the rear edge of said yarn deflector means; and said deflecting means extending outwardly beyond an end region of said yarn deflector means.

8. The apparatus as defined in claim 6, further including:

a pivotable lever arranged between said spring means and said yarn entrainment member; and said pivotable lever being pivoted by the action of said spring means.

9. An apparatus for yarn positioning during a yarn changeover operation from a full bobbin to an empty bobbin tube at an automatic winder, comprising:

two bobbin spindles which are mounted at said automatic winder and individually drivable;

said two bobbin spindles having a predetermined lengthwise axial direction;

the yarn changeover operation from a full bobbin to an empty bobbin tube respectively mounted at said two bobbin spindles being effected subsequent to formation of a full size yarn package at the full bobbin by winding an incoming yarn;

said empty bobbin tube having a yarn catch slot;

the incoming yarn to be wound at said empty bobbin tube being diverted from said full size yarn package to said yarn catch slot at said empty bobbin tube;

two separate means for yarn guidance are provided for diverting the incoming yarn from said full size yarn package to said yarn catch slot at said empty bobbin tube;

first yarn guidance means of said two separate means of yarn guidance being axially displaceable relative to said predetermined lengthwise axial direction of said two bobbin spindles;

second yarn guidance means of said two separate means for yarn guidance defining an arcuate-shaped curved path of yarn movement and containing yarn entrainment means;

displacement means provided for said second yarn guidance for relatively displacing said second yarn guidance means and said yarn entrainment means for pulling the incoming yarn across said arcuate-shaped curved path of yarn movement.

10. The apparatus as defined in claim 9, wherein:

said first yarn guidance means being axially displaceable during the changeover operation for axially positioning the incoming yarn with respect to said full size yarn package and said empty bobbin tube.

11. The apparatus as defined in claim 9, wherein:

said second yarn guidance means constitutes a yarn deflector means for deflecting the incoming yarn between said full size yarn package and said empty bobbin tube.

12. The apparatus as defined in claim 9, wherein:

said displacement means comprises a pulling element for displacing said yarn entrainment means for maintaining a predetermined axial position of the incoming yarn with respect to said full size yarn package during the changeover operation.

13. The apparatus as defined in claim 11, further including:

a turret;

said two bobbin spindles being mounted at said turret;

said turret being mounted at said automatic winder for rotation between a winding position in which the incoming yarn is wound up to form said full size yarn package and a changeover position in which the incoming yarn is diverted from said full size yarn package to said empty bobbin tube;

said first yarn guidance means being in engagement with the incoming yarn in said changeover position of said turret; and said yarn deflector means being positionable between said full size yarn package and said empty bobbin tube subsequent to rotation of said turret into the changeover position.

* * * * *